US005197169A

United States Patent [19]

Gordon

[11] Patent Number: 5,197,169

[45] Date of Patent: Mar. 30, 1993

[54] STABILIZER FOR CASKED BIER PEDESTAL

[75] Inventor: Ronald B. Gordon, Batesville, Ind.

[73] Assignee: Batesville Casket Company, Inc., Batesville, Ind.

[21] Appl. No.: 506,268

[22] Filed: Apr. 9, 1990

[51] Int. Cl.[5] ..... A61G 17/00

[52] U.S. Cl. ..... 27/27; 248/165

[58] Field of Search ..... 27/26, 27, 35; 248/165

[56] References Cited

U.S. PATENT DOCUMENTS

| | | | |
|---|---|---|---|
| 443,469 | 12/1890 | White | 27/27 |
| 1,103,286 | 7/1914 | Hallett | 248/165 |
| 1,492,998 | 5/1924 | Meeker | 27/27 |
| 1,550,295 | 8/1925 | Weber et al. | 27/27 |
| 1,558,558 | 10/1925 | Metcalf | 27/27 |
| 1,614,909 | 1/1927 | Wolfram | 27/27 |
| 2,591,261 | 4/1952 | Holahan | D7/672 |

*Primary Examiner*—Richard E. Chilcot, Jr.
*Attorney, Agent, or Firm*—Wood, Herron & Evans

[57] ABSTRACT

A casket bier pedestal has two vertical plastic sheets joined together at right angles along their center lines. They have horizontal edges, a central portion for which is notched. A rigid plastic cap having a cruciform slot receives and holds the horizontal edges of the sheets perpendicular to each other so that the pedestal does not become unstable.

3 Claims, 1 Drawing Sheet

STABILIZER FOR CASKED BIER PEDESTAL

This invention relates to a casket bier formed from two pedestals. Each pedestal consists of two plastic sheets joined to each other along their center lines, the plastic sheets being perpendicular to each other.

BACKGROUND OF THE INVENTION

It has been known to form a casket bier from a pair of vertical pedestals formed from two perpendicular plastic sheets. Each sheet is bisected by a vertical slot along one-half the length of the sheet. At a funeral site, the sheets are slid together to create a cruciform pedestal. Two pedestals are horizontally spaced from each other to form the bier on which a casket is placed.

Exact perpendicularity between the two sheets of each pedestal must be achieved and maintained. Any misalignment of the perpendicular relationship reduces the stability of the pedestal. If there is gross misalignment, the pedestal could collapse with the embarrassing consequences of the dropping of a casket. The sheets are relatively thin, that is less than $\frac{1}{4}''$ and, hence, can easily lose their perpendicular relationship upon being set up to form a bier.

SUMMARY OF THE PRESENT INVENTION

It has been an objective of the present invention to provide a stabilizer to maintain the pedestal sheets perpendicular to one another.

This objective of the present invention is attained by providing a cup-shaped element, forming a stabilizer, having a transverse wall and four generally vertical sidewalls. The transverse wall is formed with a cruciform groove of a width to receive snugly the horizontal edges of the vertical pedestal-forming sheets. Preferably, the central portion of each sheet is notched to a length which is equal to the width of the stabilizer and to a depth which, when the stabilizer is seated on the notch, will bring the upper edge of the stabilizer flush with or in the same plane as the upper edges of the pedestal forming sheets.

The several features of the invention will become more readily apparent from the following detailed description taken in conjunction with the accompanying drawings in which.

DETAILED DESCRIPTION OF THE DRAWINGS

Figure 1:
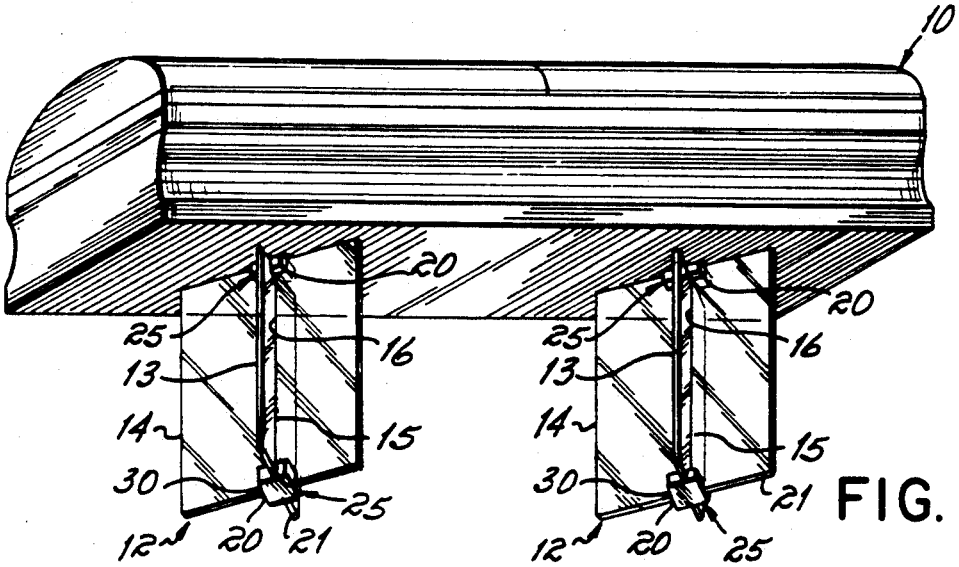
FIG. 1 is a perspective view of a casket mounted on a bier in accordance with the present invention.
Figure 4:
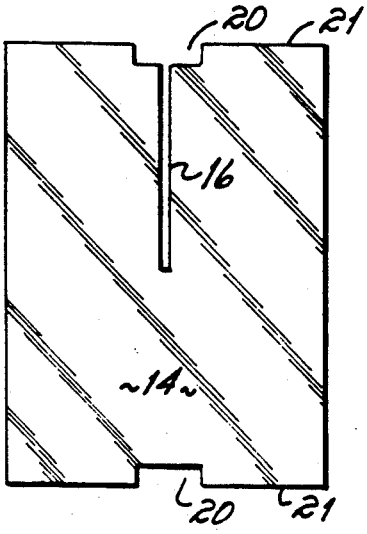
FIG. 4 is an elevational view of one of the sheets from which a pedestal is made.

Referring to FIG. 1, a casket 10 is mounted on a bier 11 formed from two pedestals 12. The pedestals are formed from two sheets 13, 14 of a rigid plastic material. Preferably, the material is a rigid transparent acrylic resin, preferably Lucite "L" by duPont. The sheet 13 has a lower vertical slot 15 in its center and the sheet 14 has an upper vertical slot 16 in its center as shown in FIG. 4. The slots permit the sheets to intersect along their centers and assume an orientation substantially perpendicular to each other.

Each sheet has a notch 20 in its upper and lower horizontal edges 21. The notch is about $3\frac{1}{4}''$ wide and $\frac{3}{4}''$ deep.

Figure 2:
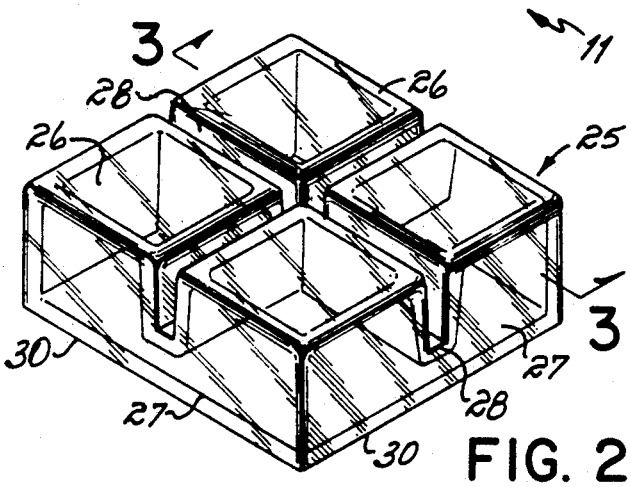
FIG. 2 is a perspective view of a stabilizer of the present invention.
Figure 3:
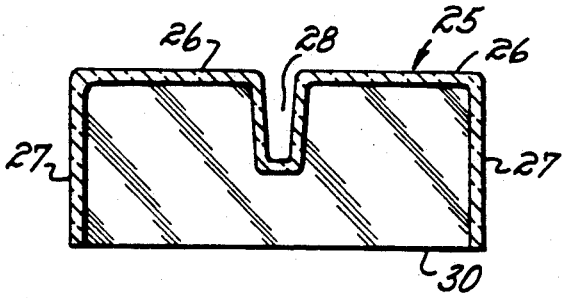
FIG. 3 is a cross-sectional view taken along lines 3—3 of FIG. 2.

The sheets are held in a horizontal orientation by caps consisting of upper and lower stabilizers 25 disposed in the notches 20. As shown in FIGS. 2 and 3, the stabilizer is formed of transparent polycarbonate, is cup-shaped and has a transverse wall 26 and four side walls 27. The transverse wall 26 is molded with a $\frac{3}{4}''$ cruciform recess 28. In the preferred form of the invention, the recess is 0.218" wide, that being the approximate thickness of the plastic sheet 13 or 14.

As can be seen from FIG. 1, when the pedestals have been assembled with the sheets positioned substantially at right angles to one another, the stabilizers 25 are slipped snugly into the notches 20 with the horizontal edges 21 of the notches extending into the recess 28. The walls 27 of each stabilizer 25 terminate in edges 30. These edges 30 are coextensive with the edges 21 of the sheets 12, 13 when the stabilizers are in position.

As can be seen from FIG. 1, when the stabilizers 25 are in position, the pedestal sheets 12 are securely held at right angles to one another so as to provide the maximum stability of the pedestals forming the bier 11.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. A casket bier pedestal comprising:

two rigid plastic vertical sheets each having a vertical slot bisecting the sheet and extending from a horizontal edge to about the center of the sheet;

said sheets being joined at said slots perpendicular to each other;

and a rigid plastic cap at each end of said sheets, said cap having a cruciform slot that receives and holds the horizontal edges of said sheets perpendicular to each other.

2. A pedestal as in claim 1 in which the horizontal edges of said sheets have central notches creating a recess;

said cap being seated in said recess, said cap having horizontal edges that are coplanar with the horizontal edges of said pedestal.

3. A method of stabilizing a casket bier pedestal presenting perpendicular upper and lower edges comprising:

use of a cup-shaped plastic member having a transverse wall and four side walls;

said transverse wall having a cruciform groove for receiving perpendicular edges of said bier pedestal.

* * * * *

UNITED STATES PATENT AND TRADEMARK OFFICE

CERTIFICATE OF CORRECTION

PATENT NO. : 5,197,169

DATED : March 30, 1993

INVENTOR(S) : Ronald B. Gordon

It is certified that error appears in the above-identified patent and that said Letters Patent is hereby corrected as shown below:

On the title page, and in column 1, line 1:
In the title of the invention, "CASKED" should be --CASKET--.

In column 2, line 7, "3 1 /4" should be --3 1/2--.

Signed and Sealed this

Fifteenth Day of March, 1994

*Attest:*

Bruce Lehman

BRUCE LEHMAN

*Attesting Officer*

*Commissioner of Patents and Trademarks*